United States Patent [19]

Tamba et al.

[11] Patent Number: 4,631,153

[45] Date of Patent: Dec. 23, 1986

[54] THROTTLE CONTROL DEVICE FOR GENERAL PURPOSE ENGINE

[75] Inventors: Shinichi Tamba, Kakogawa; Toru Ogino, Kobe; Noboru Fukui, Kakogawa, all of Japan

[73] Assignee: Kawasaki Jukogyo Kabushiki Kaisha, Japan

[21] Appl. No.: 811,328

[22] Filed: Dec. 19, 1985

Related U.S. Application Data

[63] Continuation-in-part of Ser. No. 645,173, Aug. 28, 1984, abandoned.

[30] Foreign Application Priority Data

Sep. 6, 1983 [JP] Japan ..... 58-163893

[51] Int. Cl.[4] ..... F02M 3/06

[52] U.S. Cl. ..... 261/52; 123/336

[58] Field of Search ..... 261/52; 123/336

[56] References Cited

U.S. PATENT DOCUMENTS

| | | | |
|---|---|---|---|
| 1,691,487 | 11/1928 | Levegne | 261/52 |
| 2,873,731 | 2/1959 | Richardson | 261/52 |
| 2,982,275 | 5/1961 | Doman et al. | 261/52 |
| 3,305,223 | 2/1967 | Reichenbach | 261/52 |
| 3,342,465 | 9/1967 | Szwargulski et al. | 261/52 |
| 4,079,708 | 3/1978 | Wieland | 261/52 |
| 4,490,309 | 12/1984 | Fujikawa et al. | 261/52 |

FOREIGN PATENT DOCUMENTS

| | | | |
|---|---|---|---|
| 545125 | 1/1956 | Italy | 261/52 |
| 1065241 | 4/1967 | United Kingdom | 261/52 |

*Primary Examiner*—Tim Miles

[57] ABSTRACT

A throttle control device for the general purpose engine having a throttle lever for moving a throttle valve of the carburetor and a choke lever for moving a choke valve of the carburetor. The choke lever and the throttle lever are moved together with each other in a predetermined timing. A control panel pivotally supporting the throttle lever and the choke lever is swingable in a predetermined angle range.

3 Claims, 5 Drawing Figures

THROTTLE CONTROL DEVICE FOR GENERAL PURPOSE ENGINE

This application is a continuation-in-part of application Ser. No. 645,173, filed Aug. 28, 1984, now abandoned.

FIELD OF THE INVENTION

This invention relates to a throttle control device for the general purpose engine.

DESCRIPTION OF THE PRIOR ART

In the throttle control device for the general purpose engine the throttle lever is hitherto independent from the choke lever, so that it is difficult to take a timing of their motion in each condition, i.e. slow movement, fast movement, and choke and the smooth throttle control can not be carried out. In case of the device, in which the control operation should be done near the hand as in the moving machine, the control operation is troublesome. Accordingly a system, in which the throttle lever and the choke lever have a interlocking motion with each other, has been adopted, but the device is complicated and expensive, and the regulation of an idling motion is very difficult.

Figure 1:
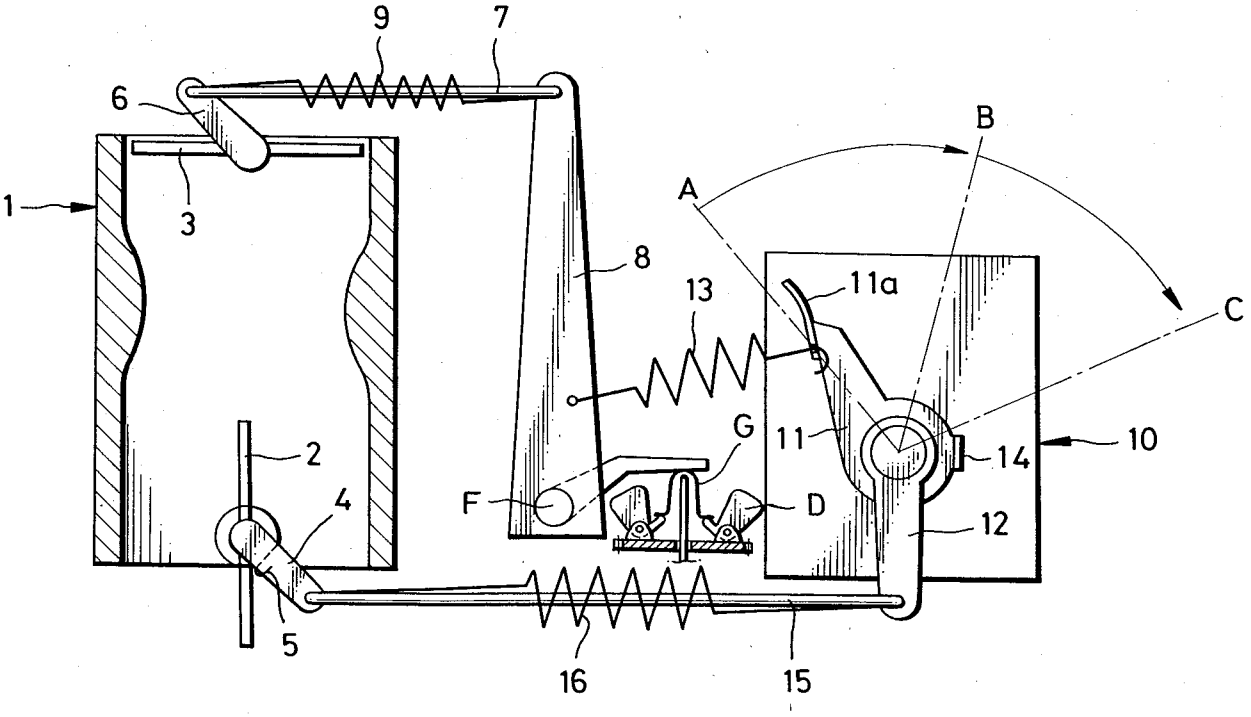
FIG. 1 PRIOR ART
FIG. 1 is a front view of an embodiment of the throttle control device for the general purpose engine of the prior art.

An instance of the throttle device of the prior art, in which the throttle lever has the interlocking motion with the choke lever, is described according to FIG. 1.

Figure 1A:
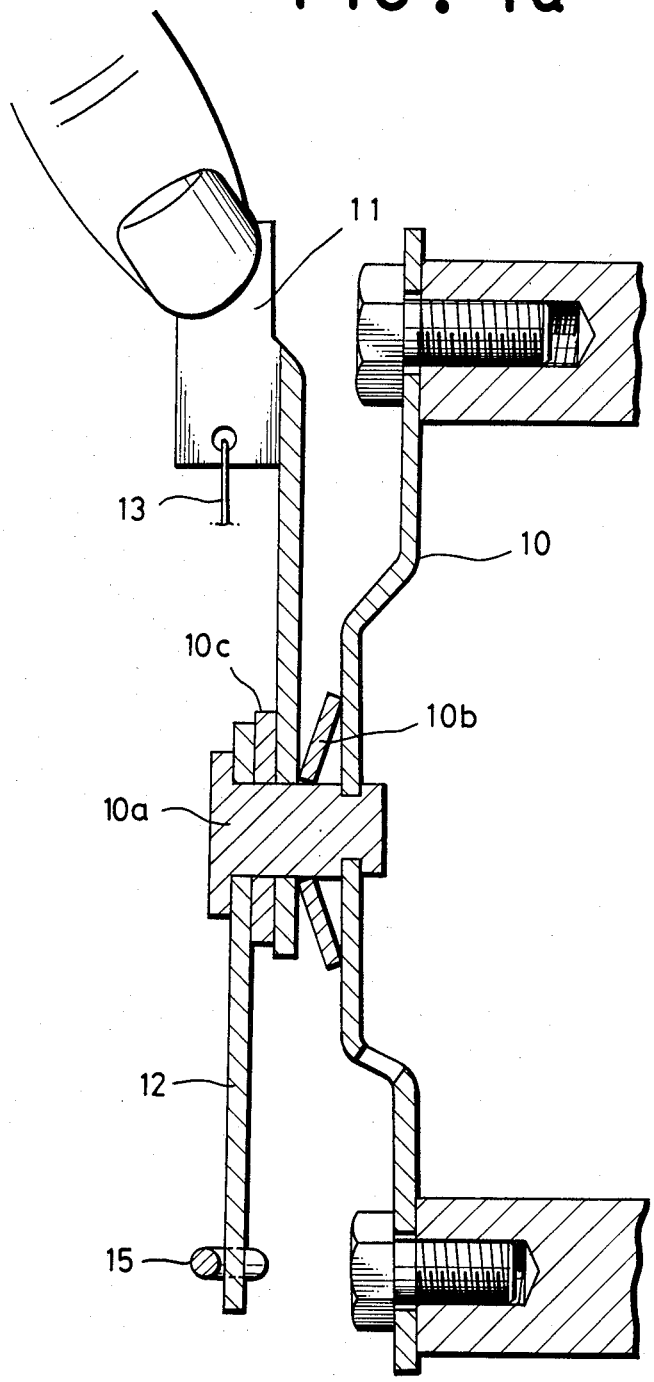
FIG. 1*a* is a sectional view of the control panel showing the mounting of the throttle and choke levers.

A carburetor is designated by 1, a choke valve by 2, a throttle valve by 3, and an arm attached to the choke valve 2 by 4. A return spring 5 is hung at one end on the arm 4 and at another end on the carburetor 1. 6 designates an arm attached to the throttle valve 3. One end of a throttle link 7 is engaged with a free end of the arm 6 and the other end of the throttle link 7 is engaged with a free end of a governor arm 8. A spring 9 is tensioned between the free end of the arm 6 and the free end of the governor arm 8. If necessary the spring 9 can be wound around the throttle link 7. 10 designates a control panel and a throttle lever 11 is pivotally supported by a shaft fixed on the control panel 10. A choke lever 12 is pivotally supported on the shaft. A spring 13 is tensioned between a curved portion 11*a* at a end of the throttle lever 11 and a middle portion of the governor arm 8. As shown in FIG. 1*a* the throttle lever 11 and choke lever 12 are biassed against a flange of the shaft 10*a* of the control panel by the thrust force of a suitable member such as conical spring washer 10*b*. A further washer 10*c* is inserted between the throttle and choke levers. The throttle lever is held stationary relative to the control panel 10 opposed to the force of the spring 13 by the frictional force between the throttle lever and the shaft. However any excessive external force such as the operator's finger as shown in FIG. 1*a* can rotate the throttle lever. A claw 14 is formed on a periphery of a supported portion of the throttle lever 11 as a bend portion and it is used for rotating the choke lever 12. A free end of the choke lever 12 is engaged with one end of a choke link 15 and the other end thereof is engaged with the arm 4 of the choke valve 2. A spring 16 is tensioned between the arm 4 and the free end of the choke lever 12. If necessary the spring 16 can be wound around the choke link 15.

In the throttle control device having such construction the throttle lever 11 is rotated from a slow position A. At that time the governor arm 8 is rotated clockwise through the spring 13 by the throttle lever 11. And the arm 6 is rotated through the throttle link 7 by the governor arm 8 and it rotates and opens the throttle valve 3. When the throttle lever 11 reaches a fast position B the throttle valve 3 is fully opened. At that time the claw 14 of the throttle lever 11 comes in contact with the side edge of the choke lever 12, then it rotates the choke lever 12 clockwise until the throttle lever 11 arrives to the choke position C under holding of the throttle valve 3 in the fully opened position. The arm 4 is rotated against the force of the return spring 5 through the choke link 15 by the choke lever 12, and the choke valve 2 is closed.

When the throttle lever 11 is returned to the fast position B from the choke position C, the arm 4 is returned by the force of restitution of the return spring 5 and the choke lever 12 is rotated counterclockwise through the choke link 15 by the arm 4 and it returns to the original position, and at that time the throttle valve is held in full open position. By moving the throttle lever 11 from the fast position B to the slow position A the claw 14 departs from the choke lever 12 but the choke valve 2 is pushed to a stopper provided in the carbureter 1 (not shown) by the return spring 5 and it is held in the full open position. As the tension force of the governor spring 13 is decreased, the throttle valve 3 is closed by turning the arm 6 through the throttle link 7, which is moved by the governor arm 8 with the counterclockwise turning force enforced by the governor weights D held by weight holders E. The rotation of the engine is transmitted to the weight holders E through a cam gear (not shown). When the rotating speed is increased the centrifugal force on weights D is increased. The increase of the centrifugal force is transmitted to a governor shaft F through a sleeve G and the governor arm 8 is rotated counter-clockwise. Therefore the throttle valve is rotated to the closing position through the link 7 and the arm 6 in order to decrease the rotating speed of the engine. FIG. 1 shows the idling condition of the engine. When the rotating speed of the engine decreases too low the arm 8 is rotated clockwise by the spring 13 opposite to the centrifugal force of the weight and the throttle valve 3 is opened to increase the rotating speed of the engine.

The engine speed is controlled dependent on the balance between the force of the spring 13 to increase the speed and the centrifugal force of the weights D for decreasing the speed.

A clockwise rotation of the throttle lever 11 increases the speed and a counterclockwise rotation therefore decreases the speed.

For adjusting the rotation of the throttle lever 11 under the full open of the throttle valve 3 in this throttle control device, the governor spring 13 is changed, or the engaging position of the spring 13 is changed, but only rough adjustment can be carried out and the engine cannot be set in any rotating speed.

SUMMARY OF THE INVENTION

This invention has been developed for the purpose of obviating the aforesaid disadvantages of the prior art. Accordingly, the invention has an object the provision of an improved throttle control device for the general purpose engine of the type in which the control panel pivotally supporting the throttle lever is rotatable.

In the present invention the maximum speed of the engine can be adjusted successively by a very easy method.

Further the invention has as its object the provision of the throttle control device in which the throttle lever and the choke lever are formed integral with each other.

In the present invention the construction of the throttle control device is simplified and the assembly of the device is simplified. Further in the present invention the motions of each portion are accurate and easy.

DESCRIPTION OF THE PREFERRED EMBODIMENTS

Preferred embodiments of the invention will now be described in detail by referring to the accompanying drawings.

Figure 2:
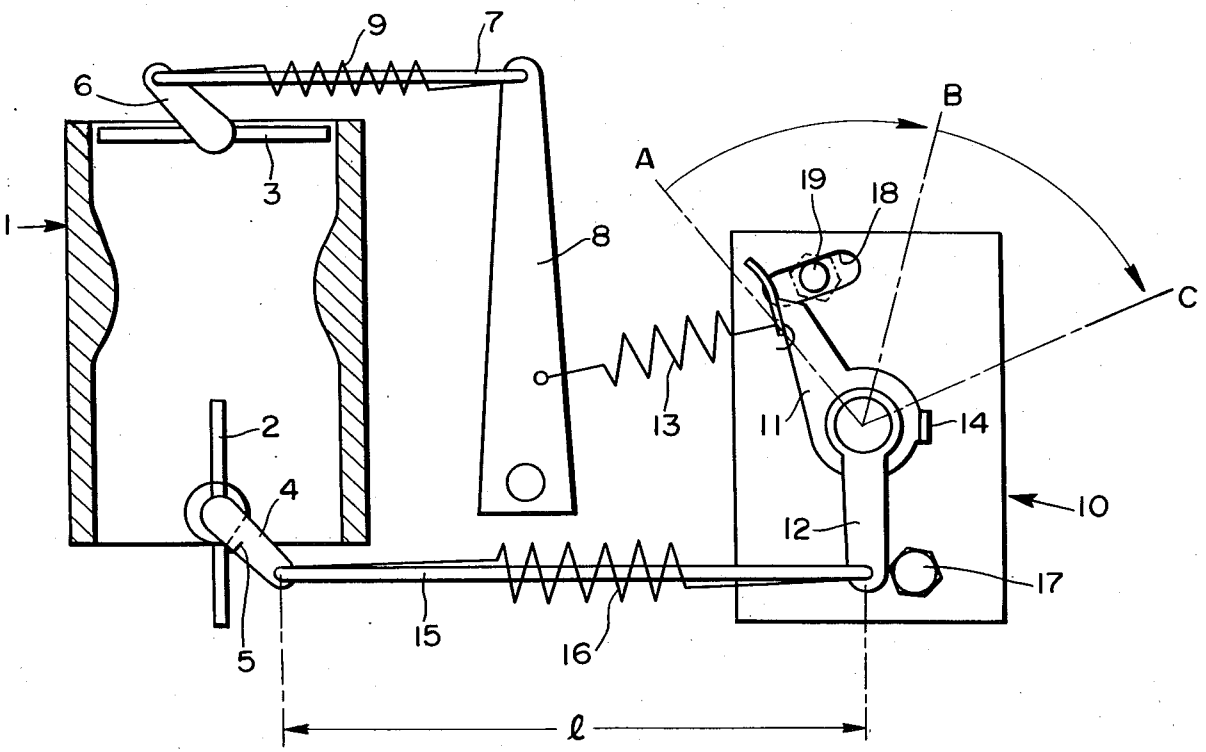
FIGS. 2 and 3 are front views of the throttle control device for the general purpose engine of the present invention.

Referring to FIG. 2, there is shown a front view of the throttle control device for the general purpose engine of the present invention. In FIG. 2 the same portions as shown in FIG. 1 are designated by the same numeral symbol, and the detailed description of them are omitted. On a control panel 10 a fastening bolt 17 is so arranged that it is positioned on a elongation of the choke link 15 in its length direction. The control panel is fixed by fastening the bolt 17 and is rotatable by loosening the bolt 17. An elongated hole 18 is formed at a left side and upper side portion of the panel 10. The elongated hole 18 is formed as an arc, the center of which is positioned on a position of the bolt 17. A guide bolt 19 is inserted through the elongated hole 18. The control panel 10 is swingable around the bolt 17 by guiding the elongated hole 18 with the guide bolt 19.

In such throttle control device, besides the action obtained by the device of FIG. 1 an adjustment of the engine speed under the full open of the throttle valve 3 can be obtained. When the bolt 17 is loosened and the control panel 10 is rotated clockwise around the bolt 17, the throttle lever 11 is moved together with the control panel 10 by the friction between the lever 11 and the control panel 10. As the control panel 10 is rotated, the fast position B and the choke position C are displaced counterclockwise. When the slow position of the throttle lever 11 is not adjusted, the slow position A is also displaced together with the fast position B and the choke position C, as the throttle lever 11 and the control panel 10 are rotated the same angle with each other. In this case the angle between the slow position A and the fast position B is not changed. But the slow position A of the throttle lever 11 can be easily adjusted after tilting of the control panel 10. After tilting of the control panel 10 the throttle lever 11 is returned toward the initial position for a suitable distance for adjusting the slow position, and the slow position of the throttle lever 11 is settled at this position by the tension force of the spring 13. In this case the tilting angle of the throttle lever 11 from the slow position to the fast position B is increased. The choke lever 12 is rotated slightly counterclockwise relative to the control panel 10, as the control panel 10 is rotated clockwise and the free end of the choke lever 12 is engaged with the choke link 15. By the rotation of the control panel and the adjustment of the slow position A of the throttle lever 11, the rotating angle of the throttle lever 11 from the slow position A to the fast position B is increased, and the rotating range of the throttle valve 11 is increased, so that the tension force of the spring 13 is increased and at that time the maximum speed of the engine is increased.

By rotating the control panel 10 along the arcuated elongated hole 18 counterclockwise on the contrary, the throttle lever 11 is at its supported portion turned together with the control panel and the throttle lever 11 is turned the same angle as the control panel 10, so that the tilting angle of the throttle lever 11 at the slow position A is decreased. A is decreased by the adjustment of the slow position of the throttle lever 11. At the same time the choke lever 12 is turned slightly clockwise relative to the control panel 10, as the free end of the choke lever 12 is engaged with the choke link 15. Therefore the rotating angle of the throttle lever 11 from the slow position A to the fast position B is decreased, and the rotating range of the throttle lever 11 is decreased, so that the tension force of the spring 13 is decreased and at that time the maximum speed of the engine is adjusted. When the control panel 10 is turned in the range of the elongated hole 18 for the adjustment of the engine speed, only the choke link 15 is swung slightly and the opening degree of the choke valve 2 is unchanged.

Figure 3:
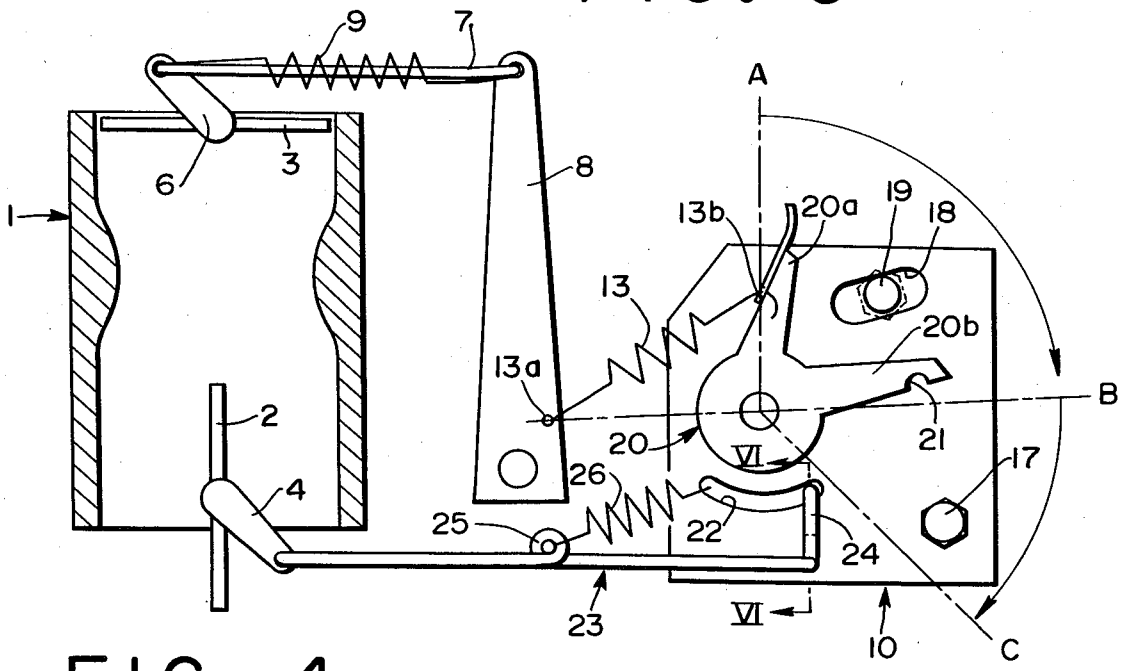
Figure 4:
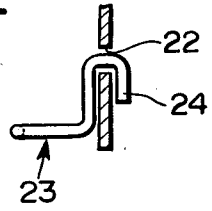
FIG. 4 is a sectional view taken along the line IV—IV of FIG. 3.

Referring to FIG. 3 the other embodiment of the present invention is described. The same position as shown in FIG. 2 is designated by the same numerical symbol, and the detailed description thereof is omitted. The control panel 10 is formed so that it is wider, and a throttle lever shaped in V-form is supported by the shaft at a left side in the middle portion of the control panel. The throttle lever 20 is formed integrally with the choke lever. Between left arm **20*a* of the throttle lever 20 and the governor arm 8 the spring 13 is tensioned. A right arm 20*b* of the throttle arm 20 has a recess 21 at an outer edge on the free end thereof. An engagement hole 13*a* formed in the governor arm 8, in which one end of the spring 13 is engaged, is arranged on an elongation of a line between an engagement hole 13*b* formed in the left arm 20*a* of the throttle lever 20 and a center of the shaft supporting the throttle lever 20. The control panel 10 has a arcuated slide hole 22, the radius center of which is arranged on the shaft supporting the throttle lever 20 at a left side on the under portion thereof. With the slide hole 22 a hook portion 24 is slidably engaged. The one end of the choke link 23 is bent in a right angle and the point portion thereof is bent in a reverse U-form as shown in FIG. 4 and forms the hook portion 24. The choke link 23 has a engagement portion 25 at a middle portion thereof. The engage portion 25 is formed by bending a portion of the choke link 23 for one round. A spring 26 is tensioned between the engagement portion 25 and the one end of the slide hole 22 (or at a left side in the lower portion of the control panel 10). The other end of the choke link 23 is engaged with the arm 4 of the choke valve 2**.

When the throttle lever 20, in the slow position A of such throttle control device, is turned clockwise, the governor arm 8 is pulled by the spring 13 against the counter-force of the governor, and thd arm 6 is rotated through the throttle link 7 by the governor arm 8. Therefore the throttle valve 3 is rotated and is opened. When the throttle lever 20 is rotated to the fast position B, the tension force of the spring 13 is increased to the maximum value, and the engine speed is increased to the maximum. At that time the tension force of the spring 13 becomes maximum, as the engagement hole 13*a* formed in the governor arm 8, the center of the shaft supporting the throttle lever 20 and the engagement hole 13*b* formed in the left arm 20*a* for engaging with the spring 13 are laid on a line. The right arm 20*b* of the throttle lever 20 is engaged at the recess 21 thereof with the portion bent in the right angle of the end of the throttle link 23. When the throttle lever 20 is turned to the choke position C, the choke line 23 is pushed by the right arm 20*b* against the force of the spring 26, which is used for preventing the play of the choke link 23, and the hook portion 24 shaped in the reverse U-form is slid along the slide hole 22. By the slide movement of the hook portion 24 of the choke link 23, the arm 4 connected with the other end of the choke link 23 is turned and the choke valve 2 is turned and closed by the movement of the choke line.

At the beginning of turning of the throttle lever 20 from the fast position B to the choke position C a distance between the engagement hole 13*a* formed in the governor arm 8 and the engagement hole 13*b* formed in the left arm 20*a* of the throttle lever 20 is decreased, so that the tension force of the spring 13 is decreased. Therefore the operating force for the throttle lever 20 is smaller than that of the embodiment shown in FIG. 2, in which the tension force of the spring 13 is increased, and the treatment of the device is easy. The choke 12 and the return spring 5 for the choke valve used in the embodiment of FIG. 2 is not necessary, so that the number of the parts is decreased and the construction is simplified.

When the throttle lever 20 is turned counterclockwise from the choke position C to the fast position B, the throttle valve 3 is held in the fully open position. The choke link 23 is returned to the original position by the restitution force of the spring 26 and the arm 4 and the choke valve are turned counterclockwise and the choke valve 2 is opened. By returning the throttle lever 20 from the fast position B to the slow position A the recess 21 of the right arm 20*b* departs from the choke link 23 and the throttle valve 3 is closed.

As the spring 26 is engaged with the engagement portion 25 formed in the choke link 23 and the slide hole 22 formed in the control panel 10 (or with a portion of the control panel 10) and tensioned therebetween, the play of the choke link 23 in turning to and from, and of the throttle 20 between the fast position B and choke position C is prevented. The spring 26 fills the function of the return spring for the choke valve 2.

When the throttle valve 3 is in full open condition of the throttle valve 3, the speed of the engine can be adjusted by loosening the bolt 17 and turning the control panel 10 around the bolt 17 for changing the turning range of the throttle lever 20 suitably.

As the control panel pivotally supporting the throttle lever is movable in the throttle control device for the general purpose engine of the present invention, the turning range of the throttle lever is suitably changeable by moving the control panel and the maximum speed of the engine is adjustable.

Additionally the throttle lever formed integrally with the choke lever is provided in the throttle control device, so that the motion from the slow position through the fast position to the choke position can be carried out easily and accurately by turning of only the throttle lever.

As shown hereinbefore the choke valve is opened and closed through the choke link, the spring for preventing the play of the choke link is used as the return spring and the choke link is engaged with the control panel without using other means by using the end portion of the choke link, which is formed as a hook portion in the reverse U-form shaped by bending itself and is engaged with the arcuated slide hole, in addition to the integral form of the choke lever and the throttle lever. Therefore the mechanism of the control system is simplified and the number of the parts is decreased. Further the assembly is simplified.

What is claimed is:

1. Throttle control device for the general purpose engine comprising;

a throttle lever pivotally supported on a control panel and connected with a throttle valve of a carburetor through a throttle link, a governor arm and a spring;

a choke lever pivotally supported on said control panel and connected with a choke valve of said carburetor through a choke link;

a fastening bolt attached to the control panel on a line extending through the choke link;

said control panel being rotatable around said fastening bolt; and said choke lever being rotatable with said throttle lever in a predetermined timing.

2. Throttle control device for the general purpose engine comprising;

a throttle lever pivotally supported on a control panel and having two arms arranged in V-form;

one of said arms being connected with a throttle valve of a carburetor through a throttle link, a governor arm and a spring;

the other of said arms having a recess;

said control panel being rotatable around a fastening bolt, and having an arcuated elongated hole, the radius center of which is arranged on an axis of said fastening bolt and an arcuated slide hole, the radius center of which is arranged on a pivotal axis of the throttle lever;

a choke link connected with a choke valve of said carburetor and having an engagement portion at a middle portion thereof and a hook portion formed at an end thereof;

said hook portion of said choke link being engaged with said slide hole; and a spring engaged with a portion of the control panel and the engagement portion of the choke link.

3. Throttle control device of claim 2, wherein said spring tensioned between said governor arm and said throttle arm extends through an extension of a line through a spring engagement position of the governor arm and the pivotal axis of the throttle lever in the fast position of the throttle lever and the other arm of the throttle lever has the recess being engageable with an end portion of the choke link in the fast position of the throttle lever.

* * * * *